United States Patent [19]

Kemeny

[11] Patent Number: 5,054,251

[45] **Date of Patent: * Oct. 8, 1991**

[54] STRUCTURAL SHOCK ISOLATION SYSTEM

[76] Inventor: Zoltan A. Kemeny, 1919 E. Colgate Dr., Tempe, Ariz. 85283

[ * ] Notice: The portion of the term of this patent subsequent to Mar. 1, 2005 has been disclaimed.

[21] Appl. No.: 652,244

[22] Filed: Feb. 5, 1991

Related U.S. Application Data

[63] Continuation of Ser. No. 162,010, Feb. 29, 1988, abandoned, which is a continuation-in-part of Ser. No. 888,963, Jul. 26, 1986, Pat. No. 4,727,695.

[51] Int. Cl.[5] ..... E04H 9/02

[52] U.S. Cl. ..... 52/167 R; 52/393; 52/573; 14/16.1; 248/634; 384/36

[58] Field of Search ..... 52/167, 729, 730, 731, 52/732; 49/1

[56] References Cited

U.S. PATENT DOCUMENTS

| | | | |
|---|---|---|---|
| 2,746,097 | 5/1956 | Tofani | 52/730 X |
| 3,296,759 | 1/1967 | Pavlecka | 52/403 X |
| 3,327,441 | 6/1967 | Kelly | 52/730 X |
| 3,788,021 | 1/1974 | Hüsler | 52/403 |
| 4,566,231 | 1/1986 | Konsevich | 52/729 X |
| 4,617,769 | 10/1986 | Fyfe et al. | 52/167 |
| 4,722,163 | 2/1988 | Thorton et al. | 52/403 X |
| 4,727,695 | 3/1988 | Kemeny | 52/167 |
| 4,830,927 | 5/1989 | Fukahori et al. | 52/167 X |
| 4,899,323 | 2/1990 | Fukahori et al. | 52/167 X |
| 4,978,581 | 12/1990 | Fukahori et al. | 52/167 X |

FOREIGN PATENT DOCUMENTS

| | | | |
|---|---|---|---|
| 240637 | 6/1962 | Australia | 52/730 |
| 519660 | 2/1931 | Fed. Rep. of Germany | 52/729 |
| 802451 | 7/1949 | Fed. Rep. of Germany | 52/729 |
| 962017 | 4/1954 | Fed. Rep. of Germany | 49/DIG. 1 |
| 3116716 | 11/1982 | Fed. Rep. of Germany | 52/DIG. TB |

*Primary Examiner*—Richard E. Chilcot, Jr.
*Assistant Examiner*—Kien T. Nguyen
*Attorney, Agent, or Firm*—Cahill, Sutton & Thomas

[57] ABSTRACT

A structural shock isolation system that may be used in building structure, or in other applications requiring load supporting elements is disclosed. The shock isolation elements of the system are divided into a plurality of parts that are keyed together with the respective parts separated by an elastomeric material. Each individual element of the structural system, while performing its load bearing function, provides shock and vibration isolation; further, since the parts of each element are keyed, the parts act as a whole in each structure to provide the required design strength for the system. The structural shock isolation system may be used in building structures as part of the superstructure of the building.

10 Claims, 4 Drawing Sheets

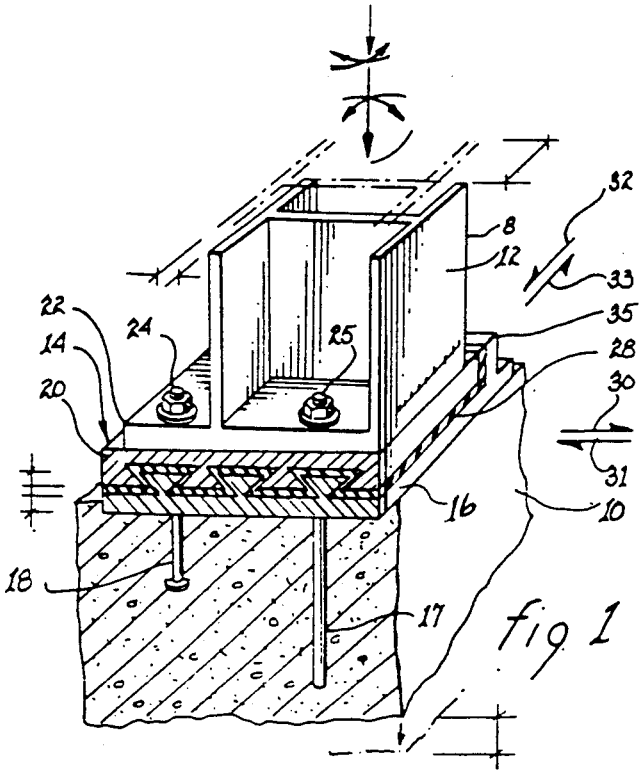
fig 1
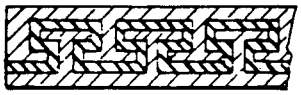
fig 2
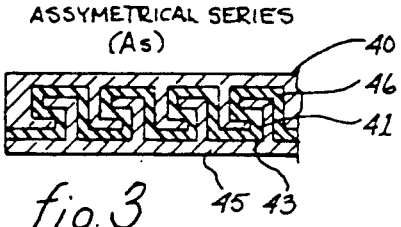
fig 3
fig 4
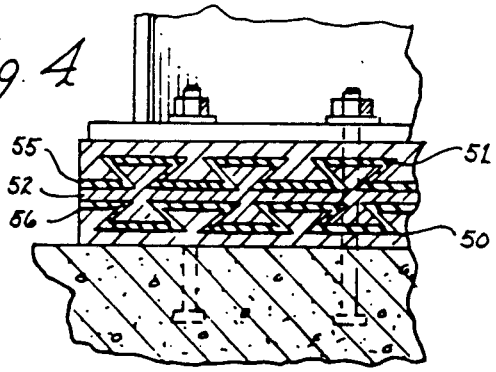
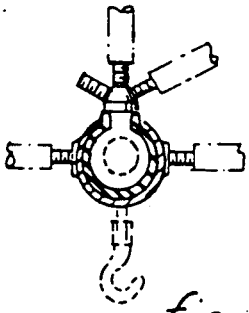
fig 10

STRUCTURAL SHOCK ISOLATION SYSTEM

This is a continuation of application Ser. No. 07/162,010, filed Feb. 29, 1988, now abandoned which is a continuation-in-part of application Ser. No. 06/888,963, filed July 24, 1986, entitled "BUILDING STRUCTURE SHOCK ISOLATION SYSTEM", now U.S. Pat. No. 4,727,695.

FIELD OF THE INVENTION

The present invention relates to shock isolation and energy dissipation systems for structural systems, and more specifically to the use of vibration isolating and energy dissipating materials such as elastomers and the like in the individual elements of structural systems to absorb externally originating shock loading.

BACKGROUND

Shock isolation has generally been treated by simply providing a shock absorbing medium between elements in a structural system. Such "cushioning" can effectively prevent the transmission of vibration and shock from one structural element to another. However, the effectiveness of the isolation system is complicated by the necessity to fasten two structures together to prevent catastrophic failures. Further, each of the individual structures in such a system fully transmits the vibration and shock from one loading point to another on the structure.

The importance of protecting buildings from vibratory or impact dynamic motions resulting from seismic disturbances, wind vortices, reciprocating or unbalanced machines, or external impact such as fragment scattering has become increasingly important. The importance of seismic insulation particularly in the construction of nuclear power plants has become a matter of substantial investigation. For example, the isolation of building structures from seismic motion has been achieved by the prior art in some instances through the utilization of an elastomer such as rubber placed between plates (usually of steel) to form aseismic bearings. These bearings are placed beneath the building structure between the structure and its foundation. The seismic subsoil motion is thus isolated by the elastomers to greatly reduce the acceleration imparted to the building structure thus eliminating or minimizing damage and inhibiting the transmission of undesirable stresses and strains.

Typically, these prior art bearings are formed having multiple plates with intermediate elastomeric material thus forming a multi-layered structure. While such structures may be effective in the isolation of certain seismic disturbances, there nevertheless exists the necessity to counteract rocking motions by anchoring the building structure to the foundation. Such anchoring is required in the prior art apart from the aseismic bearing to prevent shear forces and/or uplift forces from disturbing the structural integrity of the building.

OBJECTS OF THE INVENTION

It is therefore an object of the present invention to provide an improved vibration and shock isolation system for use in building structures.

It is another object of the present invention to provide a vibration and shock isolation system that is slide-away and separation proof while maintaining the advantages of simplicity and effectiveness of elastomeric isolation.

It is still another object of the present invention to provide a vibration and shock isolation system incorporating keyed plates separated by an elastomeric layer of material to provide uplift and shear resistance to maintain building integrity.

It is still another object of the present invention to provide a vibration and shock isolation system for utilization in a building structure incorporating shock and vibration isolation elements at strategic junctions of major structural components such as structural connections.

It is still another object of the present invention to provide energy dissipation elements, having interlocking keyed parts separated by elastomeric material that are used as structural load bearing members in a structural shock isolation system.

These and other objects of the present invention will become apparent to those skilled in the art as the description proceeds.

SUMMARY OF THE INVENTION

Briefly, in accordance with one embodiment chosen for illustration, a building structure incorporating a foundation designed to support major structural elements is provided with a plurality of aseismic bearings each positioned at a junction of the structural element and foundation. Each of the aseismic bearings incorporates a donor plate secured to the foundation and a receptor plate secured to the major structural element. A layer of elastomeric material is positioned between and in contact with the donor and receptor plates to maintain the plates separated. The plates are formed having interlocking cross-sectional configurations with respect to each other to form a keyed layered structure with the keyed donor and receptor plates separated by the elastomeric material to provide a shear and uplift proof intermediate element between the foundation and the major structural component.

BRIEF DESCRIPTION OF THE DRAWINGS

The present invention may more readily be described by reference to the accompanying drawings in which:

FIG. 1 is an isometric view, partly in section, showing an aseismic bearing constructed in accordance with the teachings of the present invention positioned between a building foundation and a major structural component.

FIG. 2 is a cross-sectional view of an alternative configuration of the aseismic bearing shown in FIG. 1.

FIG. 3 is a cross-sectional view showing another alternative configuration of an aseismic bearing constructed in accordance with the teachings of the present invention.

FIG. 4 is a cross-sectional view of an alternative configuration of an aseismic bearing constructed in accordance with the teachings of the present invention showing the use of an interceptor plate.

FIG. 10 is a representation of the concept of the present invention embodied in a space truss.

DETAILED DESCRIPTION OF THE PREFERRED EMBODIMENT

Figure 5:
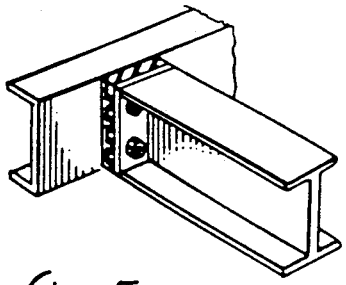
FIG. 5 is an isometric view showing a vibration and shock isolation element positioned between elements of the superstructure of a building.

Referring now to FIG. 1, a foundation 10 is shown for supporting a major structural element of a building, in this particular instance a column 12. A vibration and shock isolation bearing system 14 is provided including a donor plate 16 secured to the foundation 10. The donor plate 16 may be secured in any of several fashions including anchoring bar 17 that is welded or otherwise secured to the bottom (not shown) of the donor plate 16 or an anchoring bolt or headed anchor stud 18 similarly attached to the donor plate 16. It may be noted that at this juncture, the donor plate 16 is firmly and permanently secured to the foundation 10 and receives substantially all stresses transmitted by the foundation 10.

A receptor plate 20 is secured to the column 12 in any convenient manner such as by welding a base plate 22 to the bottom of the column 12 to receive threaded bolts such as those shown at 24 and 25 and their corresponding nuts. The bolts 24 and 25 are welded or otherwise secured to the receptor plate 20. It may be noted that the receptor plate 20 is thus firmly and rigidly secured to the column 12 and will transmit any and all forces received by it directly to the column 12.

Each of the plates 16 and 20 have interlocking cross-sectional configurations with respect to each other to form a keyed interlocking structure. A layer of elastomeric material 28 is positioned between and in contact with the plates 16 and 20 to dynamically maintain the plates separated. Thus, seismic motions transmitted from the foundation 10 are dampened and dissipated by the elastomeric layer prior to transmission to the column 12. Similarly, wind vortex, impact, or imbalanced machine forces are dampened and dissipated in the layer 28 prior to the transmission from the column 12 to the foundation 10.

It is important to note that the vibration and shock isolation bearing system 14 not only provides the function of vibratory or impact dynamic motion dampening, but also provides a shear proof and uplift proof coupling between the foundation 10 and the column 12. That is, unlike the multi-layered flat plate structures in the prior art, no structural connection need be made between the major structural elements of the building such as the column 12 and the foundation 10 other than the vibration and shock isolation bearing of the present invention. During the occurrence of a shock (seismic for example) the two structural parts 10 and 12 develop a limited local displacement controlled by the size and geometry of the elastomeric layer 28. Similarly, during vibration this limited displacement reduces the force being transmitted from one structural part to the other. A continuous vibration resulting from such things as unbalanced mechanical machinery is isolated from one major structural component to the other by the elastomeric layer which isolates the transmitted motion and absorbs energy creating heat in the layer 28. In the event of the occurrence of excessive amplitudes of the shock or vibration, the interlocking cross-sectional configuration of the plates 16 and 20 prevent structural failure of the joint and transfers the excessive forces to ductile structural parts of the building structure.

It may be noted that the embodiment chosen for illustration in FIG. 1 incorporates plates 16 and 20 having interlocking cross-sectional configurations forming longitudinally extending keys. These keys prevent shear force failure resulting from shear forces in the direction of the arrows 30 and 31; prevention of shear failure may be provided in the direction of the arrows 32 and 33 by incorporating an end plate such as that shown at 35 and a similar plate (not shown) at an opposing end of the donor plate 16. Similarly, omnidirectional shear profing may be achieved by incorporating an interlocking cross-sectional configuration incorporating different types of shear key patterns. Such patterns as those shown in FIGS. 9*a* through 9*f* would provide protection against shear failure in multiple directions.

Figure 9A:
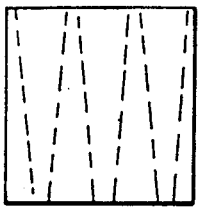
FIG. 9*a* through a*f* are schematic representations of alternate types of shear key patterns for use in the vibration and shock isolation system of the present invention.
Figure 9B:
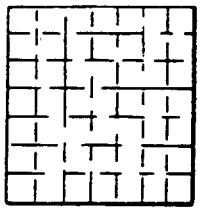
Figure 9C:
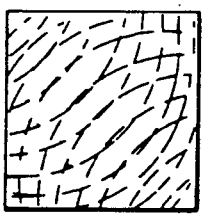
Figure 9D:
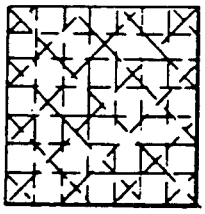
Figure 9E:
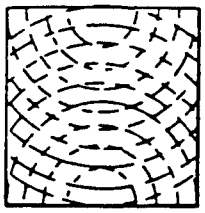
Figure 9F:
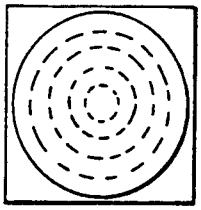

FIG. 9*a* illustrates the utilization of interlocked donor and receptor plates wherein the keyways are tapered in the plan view; similarly, the interlocking plates of FIGS. 9*c*, 9*e* and 9*f* represent arcuate, semicircular, or circular keyways wherein the receptor and donor plates are first keyed to an interlocking position with respect to each other by rotating one with respect to the other. With regard to FIG. 9*f*, the circular interlocking keyways would first have to be formed using semicircular keyways in a manner similar to that in FIG. 9*e*. The circular configuration of the keys and keyways in FIG. 9*f* would thus be achieved by using semicircular donor and receptor plates that are keyed and rotated with respect to each other to interlock same and then using a duplicate pair of receptor and donor plates and welding the two halves of the interlocked plates together to form the configuration shown in FIG. 9*f*. The keying configurations of FIGS. 9*b* and 9*d* are multi-layer configuration; that is, the donor and receptor plates in FIG. 9*b* may be the same as that shown with respect to FIG. 1 with the addition of a second layer of donor and receptor plates with the keyways orthogonally related to the keyways of the first donor and receptor plates. Similarly, the configuration of 9*d* utilizes a multi-layered structure including keyways orthogonally related as well as angled at a 45° angle with respect to each other.

FIG. 2 represents an alternative keying pattern that may be utilized for the donor and receptor plates. It is noted that although the cross-sectional configuration of the plates is different from that shown in FIG. 1, the plates nevertheless have interlocking cross-sectional configurations with respect to each other to form a keyed shear and uplift proof bearing structure. Similarly, the alternative cross-sectional configuration shown in FIG. 3 provides the same keyed structure but uses non-symmetrical keys and keyways to provide the interlocking relationship between the plates. That is, plate 40 is provided with "L" shaped keys 41 that extend into corresponding keyways 43 provided in the plate 45. Similar keys and keyways are provided in the plate 45 and 40 respectively, the plates 40 and 45 may be identical as shown in FIG. 3 or may vary with respect to each other; for example, the plate may be different thickness. The space between the plates is filled with a layer 46 of elastomeric material in the manner described previously in connection with the embodiment of FIG. 1. Although the keys and keyways of FIG. 3 are non-symmetrical, the form of the plates still provide an interlocking relationship with respect to each other to provide a shear and uplift proof structure.

The ability of the aseismic bearing of the present invention to prevent bearing failure due to displacement and to prevent failure resulting from uplift forces is important. The total displacement permitted by the bearing is limited to the space occupied by the elastomeric layer; in the event the forces on the bearing exceed the ability of the elastomeric layer to withstand the force, the elastomeric layer may be destroyed but the displacement in the shear direction or in the uplift direction is strictly limited by the interlocking of the plates. In this manner, anticipated vibratory or shock loading may be accommodated by the size and specific shape of the elastomeric layer; however, extremely severe shocks (those beyond the anticipated shock values) will not destroy the integrity of the structural joint incorporating the bearing.

The embodiment shown in FIG. 4 incorporates a donor plate 50 as well as a receptor plate 51. The donor and receptor plates are interlocked with respect to each other through the utilization of an interceptor plate 52 which is positioned between the donor and receptor plates and is keyed to provide an interlocking relationship among all three plates. The elastomeric layer may take the form of two separate layers 55 and 56 positioned between the interceptor plate 52 and the receptor plate as well as between the interceptor plate and the donor plate respectively. The utilization of an interceptor plate such as that shown in FIG. 4 may provide the means whereby an increased displacement may be accommodated in response to dynamic forces without increasing the specific thickness of an individual elastomeric layer.

The present invention also incorporates the distribution of shock and vibration bearings at strategic locations throughout the building superstructure. For example, FIGS. 5, 6, 7, 8 and 10 each show the utilization of a bearing constructed in accordance with the teachings of the present invention at various junctures of structural elements typically found in building superstructures. In each instance, the structural elements are connected through plates having interlocking cross-sectional configurations such that the structural elements are connected to each other only through the vibration and shock absorbing elastomeric layer. In each instance, it is important to note that the structural integrity of the joint between the structural elements is assured since the interlocking relationship of the plates prevents separation of the plates even if, for any reason, the intervening elastomeric layer is destroyed. Further, each of the vibration and shock isolation couplings between the structural elements may take the form of interlocking cross-sectional configurations forming a keyed structure such as that shown in FIG. 1, or may take any of the alternative keyed configurations such as those shown in FIGS. 2 and 3. The shock and vibration isolating characteristics of joints between major structural components of a building will provide significant isolation to major seismic shocks and will assist in the distribution of seismic loads imposed on the structure. It is important that the aseismic joints provide complete elastomeric isolation between the joined parts while the requirement of structural integrity is of equal importance. That is, each joint must be capable of providing joint integrity even if the elastomeric layer is destroyed. The importance of the "keying" thus becomes apparent when it is recognized that structural integrity of the joint must be guaranteed without sacrificing the vibration and shock isolation characteristics of the elastomeric layer.

Figure 11:
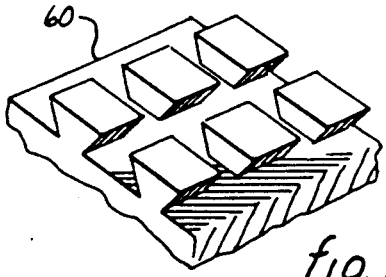
FIG. 11 is an isometric illustration of an alternate form of interlocking plate that may be used in the concept of the present invention and one which may be useful to decrease the stiffness of the elastomeric layer.

The stiffness of any particular elastomeric layer may be chosen in accordance with the particular loads that a specific design is intended to encounter. The stiffness may be altered in various ways such as by the utilization of interrupted keys such as shown in FIG. 11 wherein it may be seen that an elastomeric layer placed in the interstices between the keys of the plate 60 (and a keyed interlocking plate-not shown) may bulge into the interstices between the adjacent keys to thus provide a less stiff aseismic joint.

Figure 6:
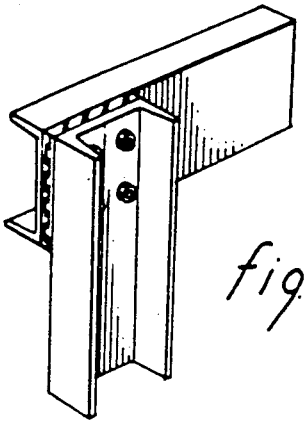
FIG. 6 is an isometric view showing a vibration and shock isolation element positioned between elements of the superstructure of a building.
Figure 7:
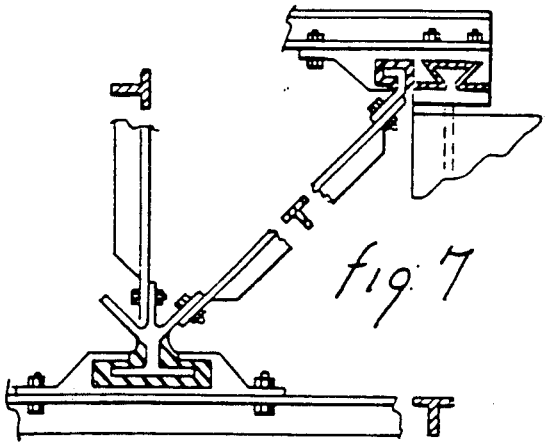
FIG. 7 is an illustration of the utilization of a vibration and shock isolation device constructed in accordance with the teachings of the present invention used in a truss structure.
Figure 8:
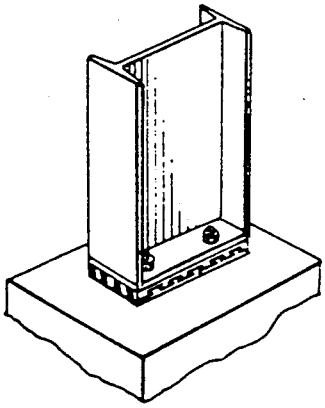
FIG. 8 is an isometric view of the use of a vibration and shock isolation element constructed in accordance with the teachings of the present invention positioned between a column and a supporting base.

The utilization of vibration and shock isolation throughout the building structure provides a significant improvement in the ability of the structure to withstand such loads. The incorporation of such bearings in Spandrell joints such as shown in FIG. 5 or subframing joints such as shown in FIG. 6 provide a predetermined design flexibility to the entire superstructure of the building. Similarly, column and base junctures such as shown in FIG. 8 or plane truss joints as shown in FIG. 7 incorporated in the building structure provide flexibility without sacrificing structural integrity. Similarly, the space truss structure shown in FIG. 10 provides similar advantages in the overall building structure. Thus, the individual joints are provided with an elastomeric vibration and shock isolation and can also provide vibratory energy dissipation. The interlocking nature of the respective joints provides a shear, uplift, torsion, and moment proof connection between respective building components; that is, the forces transmitted through the joint, regardless of the nature of the force, will not cause the loss of integrity of the joint.

It may also be noted that an aseismic bearing may be formed in accordance with the teachings of the present invention without the specific utilization of a separate donor and receptor plate. That is, it is possible in certain environments, to form interlocking keys in supporting and supported components of the building without separate plates. For example, the utilization of appropriate concrete forms can be used to form interlocking keys between a column and a base provided however that an elastomeric layer be appropriately positioned between the two and provided also that appropriate reinforcing be added to the concrete to provide the appropriate strength necessary to accommodate design moment or uplift forces. It will be apparent to those skilled in the art that the donor and receptor plates need not be made of steel or metal and can be made of other materials; however, in most applications metal plates will provide the necessary strength accompanied by convenient characteristics.

Figure 13C:
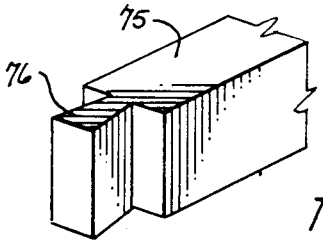
FIGS. 13*a*, 13*b*, and 13*c* are illustrations of structural elements constructed in accordance with the teachings of the present invention.
Figure 13A:
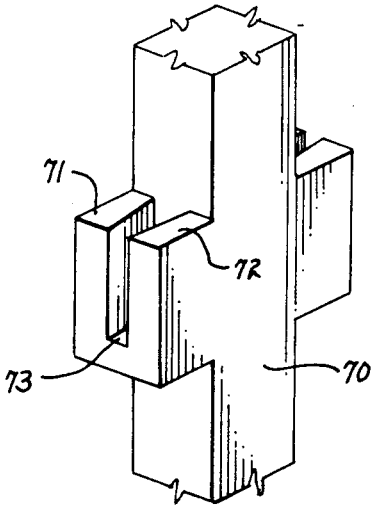
Figure 13B:
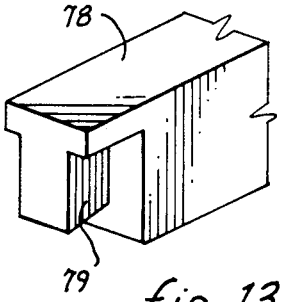

Referring now to FIGS. 13*a* and 13*b*, it may be seen that interlocking keys may be formed in the structural elements of the building without use of separate plates. For example, a side column 70 is shown having a pair of opposed keyways 71 and 72 formed integrally therewith. The keyways may be fabricated and welded onto the column 70 so that the keyways are actually part of the column itself. Each keyway is provided with a floor 73 that engages and supports a corresponding key formed at the end of a beam. The floor may conventionally be covered with, or coated with, an appropriate elastomer.

A beam, such as that shown at 75 in FIG. 13*b* is provided with a key 76 formed at the end thereof that can be lowered into the keyway provided on the column 70. An elastomeric material may then be placed in any convenient manner, such as by injection, between the walls of the keyway on the column and the key on the end of the beam. If desired, the top of the keyway may be closed over the beam by an appropriate plate welded to the keyway. The important features of the joint thus formed are that the structural elements comprising the column 70 and the beam 75, when placed together, form a keyed interlocking joint having a layer of elastomeric material positioned between and in contact with the surfaces of the key and the keyway.

The joint thus formed will provide shock and vibration isolation as well as energy absorption while nevertheless providing an interlocking connection for the receipt and transmission of forces. The closed floor 73 of the column 70 may be eliminated through the utilization of a beam having an end configuration such as that shown in FIGS. 13*c*. The latter beam 78 incorporates a closed top key 79 that may rest upon the top of the keyway 71 or 72 of the column 70.

Figure 12A:
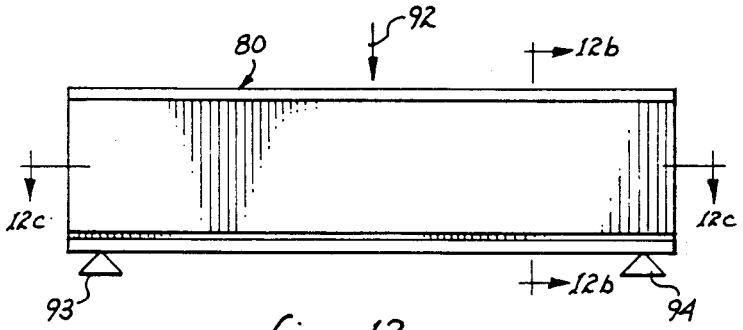
FIGS. 12*a*, 12*b*, and 12*c* are illustrations of load bearing elements constructed in accordance with the teachings of the present invention.
Figure 12B:
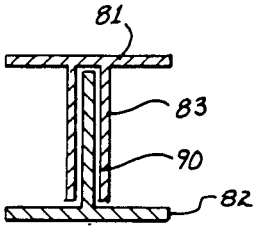
Figure 12C:
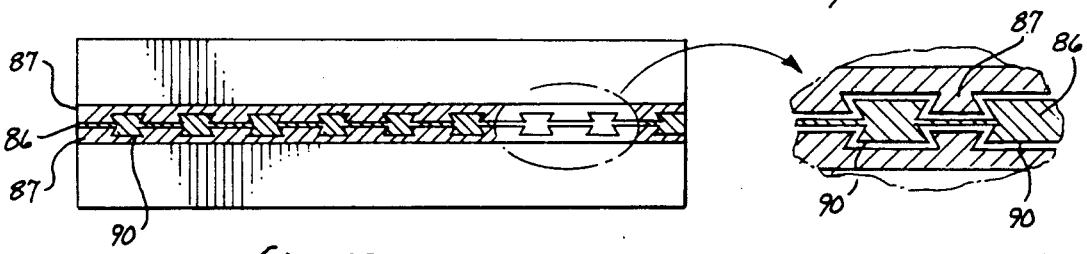

In the above instances, the structural shock isolation system incorporated structural components that were keyed together using an elastomeric layer therebetween for isolation of vibration and shock and for energy absorption. However, it may be possible to accomplish similar goals through the use of individual load bearing elements that are formed from parts that are keyed together and separated by elastomeric material. The utilization of such load bearing elements as structural components or elements may be used in combination with or in lieu of the joint structures previously described or may be used to complement other types of shock isolation. Referring to FIG. 12, an I beam is shown that may be considered to be a single load bearing element. Referring to FIGS. 12*a*, 12*b* and 12*c*, the I beam 80 is formed from two parts, a top 81, and a bottom 82. Both the top and the bottom have formed integrally therewith a portion of the web 83 extending between the top and the bottom. As may most clearly be seen by reference to FIG. 12*c*, that portion of the web shown at 86 is actually formed as an integral part of the bottom 82 of the beam; similarly, those portions of the web 83 shown at 87 are formed integrally with the top 81 of the beam. It may thus be seen that the web 83 is actually a series of interlocking keys and keyways with the keyways formed as part of the top 81 of the beam while the keys 86 are formed as part of the bottom 82 of the beam. An elastomeric material 90 is positioned between and in contact with the interlocking portions of the top and bottom to maintain the keys and keyways separated and to provide shock and vibration isolation and energy absorption.

Figure 16:
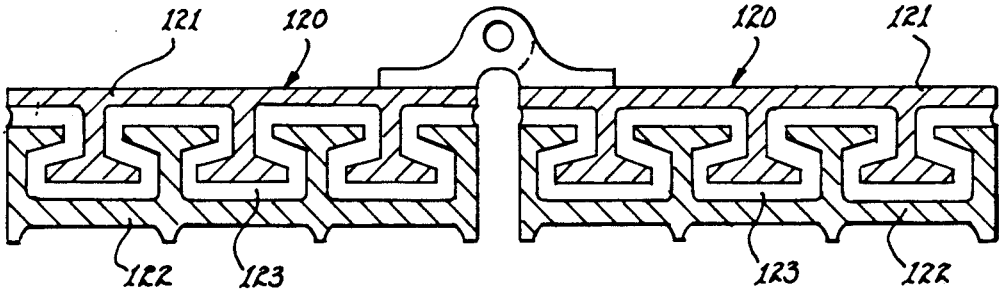
FIG. 16 is an illustration of another load bearing element constructed in accordance with the teachings of the present invention useful for applications other than building construction.

When the I beam of FIGS. 12*a*, 12*b* and 12*c* is subjected to conventional forces that are typically found in conventional construction techniques, it may be seen that both the top and the bottom of the I beam form parts that are load bearing while nevertheless continuously providing the abovementioned isolation function. For example, if a force is applied such as at the arrow shown at 92 in FIG. 12*a*, while the beam is supported as shown at 93 and 94, both the top 81 and the bottom 82 of the load bearing element formed by the I beam are load bearing parts that are separated by elastomeric material to provide shock and vibration isolation and to absorb energy. Even though the separate parts (the top and the bottom) of the I beam are load bearing, and are separated by an elastomeric material, the keyed interlocking configuration connecting the two parts guarantee structural integrity even though the elastomeric material may fail. Such load bearing elements incorporating keyed and elastomeric separated parts may take various forms and have a variety of applications other than building structures. For example, FIG. 16 illustrates individual track elements 120 having upper and lower parts 121 and 122 that are interlocking and separated by an elastomeric layer 123. The track elements may be connected to form an endless track for use on tracked vehicles such as bulldozers or military tanks.

Figure 14:
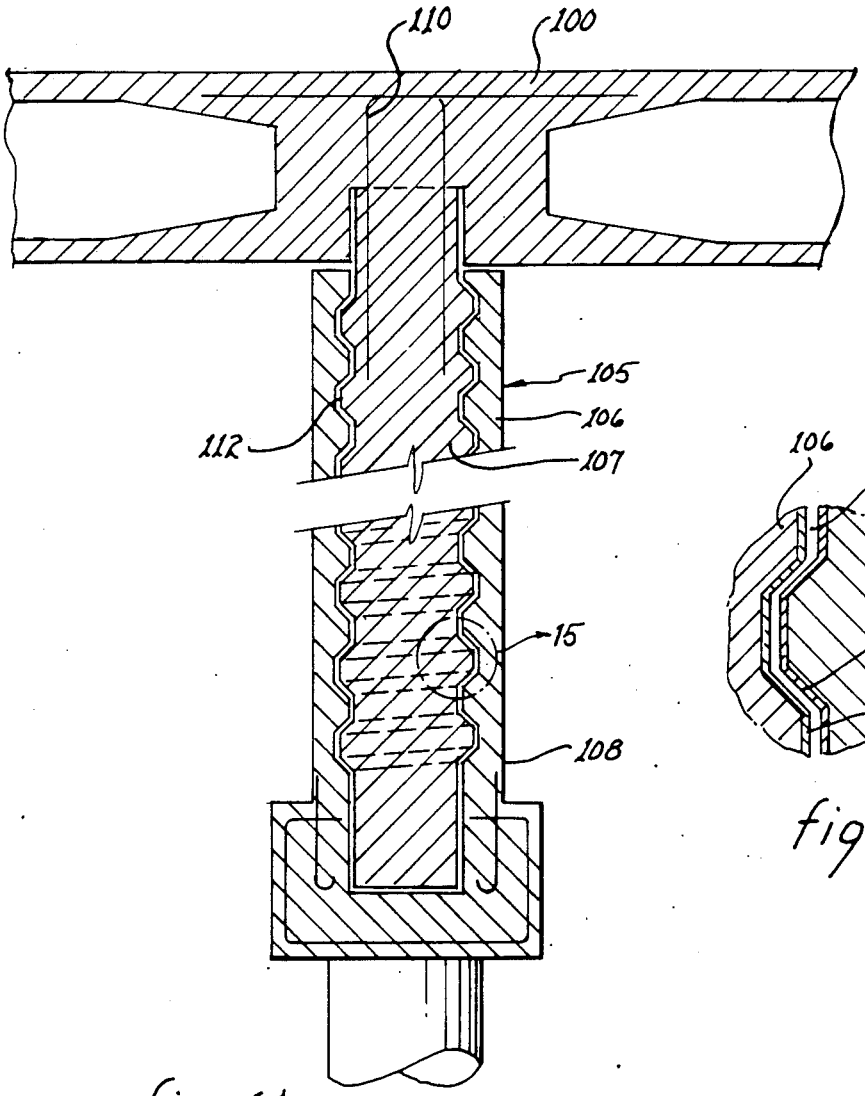
FIG. 14 is a cross-sectional configuration of another embodiment of structural elements forming a keyed interlocking joint therebetween and incorporating elastomeric material in accordance with the teachings of the present invention.

FIG. 14 illustrates a structural shock isolation system constructed in accordance with the teachings of the present invention and incorporating concrete technology. Referring to FIG. 14, a bridge deck 100 is shown that may be cast in place over a pier 105, the latter providing support for the deck. The pier 105 is formed of an outer shell 106 and an inner core 107. The junction between the pier 105 and the bridge deck 100 may simply be a cold joint having reinforcing bars 110 extending upwardly from the core 107 and imbedded in the concrete of the bridge deck when poured.

Figure 15:
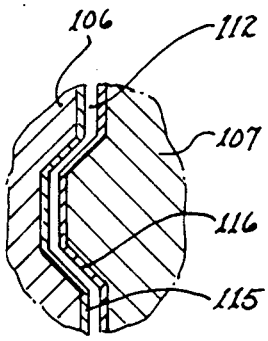
FIG. 15 is an enlarged portion of FIG. 14 showing the interlocking joint between structural elements of FIG. 14.

The outer shell 108 of the pier may be steel pipe or spiral reinforcing. The junction 112 between the outer shell and inner core 106 and 107, respectively, may more clearly be shown by reference to FIG. 15. The outer shell is provided with an interior thread that may conveniently be formed through the utilization of a spiral formed corrugated metal liner 115, while the core 107 is provided with mating male threads that also may be formed through the utilization of a spiral corrugated metal encasement 116. A space between the outer shell and inner core is filled with an elastomeric material such as cold cast urethane.

The pier 105 is therefore a load bearing element incorporating two parts separated by an elastomeric layer. The individual parts, that is, the outer shell and the inner core form a keyed interlocking configuration that provide the necessary structural integrity in the event of elastomeric failure. The load bearing element, that is the pier, performs the necessary function of support for the bridge deck while still providing shock and vibration isolation as well as energy absorption.

What is claimed is:

1. In a building structure having a plurality of structural load bearing elements to be secured to each other, a vibration and shock isolation and energy absorption system comprising:

(a) a plurality of structural load bearing elements, each connected to at least one other structural load bearing element;

(b) each of said structural load bearing elements, when connected to another structural load bearing element, forming a keyed interlocking configuration with such other structural load bearing element to form a keyed interlocking load bearing joint therebetween; and (c) a layer of compression load bearing elastomeric material positioned between and in contact with said connected structural elements at said interlocking joint to maintain separation between said elements;

whereby said structural load bearing elements are interlocked with each other at said joints and are separated at said joints by said load bearing elastomeric material.

2. The combination set forth in claim 1 wherein said structural elements are columns having keyways formed therein and beams having keys formed therein, and wherein said keys and keyways are joined having an elastomeric material therebetween.

3. A structural vibration and shock isolation and energy absorption system comprising:

(a) a plurality of structural load bearing elements, each connected to at least one other structural load bearing element;

(b) each of said structural load bearing elements, when connected to another structural load bearing element, forming a keyed interlocking configuration with such other structural load bearing element to form a keyed interlocking load bearing joint therebetween; and (c) a layer of load bearing elastomeric material positioned between and in contact with said connected structural elements at said interlocking joint to maintain separation between said elements;

whereby said structural load bearing elements are interlocked with each other at said joints and are separated at said joints by said load bearing elastomeric material.

4. The combination set forth in claim 3 wherein said load bearing elements are I beams.

5. The combination set forth in claim 3 wherein said load bearing elements are individual track elements connectable to other track elements to form an endless track.

6. The combination set forth in claim 3 wherein said load bearing elements are bridge piers.

7. A vibration and shock isolation and energy absorbing load bearing element having first and second load bearing parts separated by a load bearing elastomeric material in contact with said parts, said parts having a keyed interlocking configuration with respect to each other to form a load bearing joint therebetween.

8. The load bearing element of claim 7 wherein said parts are the top and bottom of an I beam, and said top and bottom incorporate a keyed interlocking web extending therebetween.

9. The combination set forth in claim 7 wherein said load bearing element is an individual track element connectable to other track elements to form an endless track.

10. The combination set forth in claim 7 wherein said load bearing element is a bridge pier.

* * * * *